US008926118B1

(12) United States Patent
Whittaker

(10) Patent No.: US 8,926,118 B1
(45) Date of Patent: Jan. 6, 2015

(54) DEVICE FOR MOUNTING LIGHTS TO A STRUCTURE

(76) Inventor: Ryan Whittaker, West Jordan, UT (US)

( * ) Notice: Subject to any disclaimer, the term of this patent is extended or adjusted under 35 U.S.C. 154(b) by 457 days.

(21) Appl. No.: 13/345,470

(22) Filed: Jan. 6, 2012

Related U.S. Application Data

(60) Provisional application No. 61/430,249, filed on Jan. 6, 2011.

(51) Int. Cl.
*F21S 8/00* (2006.01)
*F21V 21/00* (2006.01)

(52) U.S. Cl.
USPC ..... 362/145; 362/240

(58) Field of Classification Search
CPC . F21S 4/003; F21V 33/006; F21W 2121/004; F21W 2121/00; F21Y 2101/02
USPC ..... 362/145
See application file for complete search history.

(56) References Cited

U.S. PATENT DOCUMENTS

| | | | | |
|---|---|---|---|---|
| 5,833,332 | A * | 11/1998 | Marshall et al. | 312/223.3 |
| 7,344,265 | B1 | 3/2008 | Tieken | |
| 2004/0105255 | A1 * | 6/2004 | Seeburger | 362/145 |

* cited by examiner

*Primary Examiner* — Joseph L Williams
(74) *Attorney, Agent, or Firm* — Jones Waldo Holbrook & McDonough, PC; Brent T. Winder

(57) ABSTRACT

A device for mounting lights to a structure. The device has a channel defining an enclosure. A surface of the channel includes one or more openings through which light bulbs are substantially wholly or partly visible. The device can be attached to a structure with various attachment mechanisms. In one embodiment, the channel is directly attached to the structure. In other embodiments, a detachable clip assembly is utilized. The channel can include a securing mechanism to secure the light bulb substantially in the opening. This securing mechanism can also function as a J clip to secure the channel to the structure. The channel can include a sloped drip cap. The device can be adapted to a wide variety of structures and light displays.

19 Claims, 13 Drawing Sheets

DEVICE FOR MOUNTING LIGHTS TO A STRUCTURE

PRIORITY

This application claims priority to provisional application No. 61/430,249, filed Jan. 6, 2011 which is hereby incorporated by reference for its supporting teachings.

BACKGROUND

String lights are used to decorate numerous structures on a variety of occasions. For example, the exteriors of commercial buildings and homes are lined with lights at Christmas. String lights are also becoming increasingly popular Halloween, Thanksgiving and Independence Day home decorations. They are employed for summer outdoor entertaining, weddings and countless other occasions.

Mounting string lights on structures can be challenging in terms of hanging them straightly and evenly. Installing and removing string lights can also damage the structure to which they are affixed. For example, attaching the lights often requires the use of nails, staples or other similar fastening mechanisms which can, with repeated use, cause significant damage to the structure exterior. It also creates unsightly holes which can diminish property value. The use of current fastening mechanisms also makes removal of string lights extremely difficult. The fasteners must be individually removed; or in some cases, the lights are simply pulled down which makes them much more prone to damage. Additionally, most temporary fastening systems are made out of a weak plastic that becomes brittle over a short time of exposure to ultra violet rays.

Repeated installation and removal of string lights can even be dangerous in that installers are often perched precariously on ladders, frequently in icy conditions. Mounting string lights on a roofline or against a rain gutter system—which is often where such lights are installed—also exposes the electrical wiring and bulb to harmful weather and ultraviolet damage.

The foregoing issues among others are solved by the present invention in its various embodiments.

SUMMARY

The present invention in its various embodiments is a device for mounting lights to a structure. The device includes a channel that defines an enclosure. The channel has one or more surfaces which include openings through which light bulbs are substantially wholly or partly visible. The channel can be secured to the structure by inserting a mounting edge under a fascia of the structure. The channel can also be secured by utilizing detachable clip base and J clip assembly. In one embodiment, the clip base is secured to the structure by screws, lag bolts or other known fastening mechanisms. The channel has a J clip on a first edge that is able to engage a first edge of a detachable clip base. In some embodiments, the channel includes a second J clip on a second edge that is able to engage a second edge of the detachable clip base. This second edge of the detachable clip base can also be a J clip.

In some instances, the detachable clip base is a single, substantially rectangular piece running substantially coincidental with the channel on the structure. In other instances, the detachable clip can be multiple pieces running substantially coincidental with the channel on the structure.

The channel can include a securing mechanism to secure the light bulb substantially in the opening. In some instances, this securing mechanism also can function as a J clip to secure the channel to the structure.

The channel can include a sloped drip cap. In some embodiments, such as those adapted for ridge line roofs, a second channel defining a second enclosure and having one or more openings for light bulbs can also be included. The first and second channels can be attached to the structure in a variety of ways including, but not limited to lag bolts, screws and nails. A ridge cap cover can be coupled to the first and second channel. In one embodiment, the ridge cap cover has one or more openings through which the light bulbs can be made visible.

DETAILED DESCRIPTION OF THE ILLUSTRATED INVENTION

Figure 1:
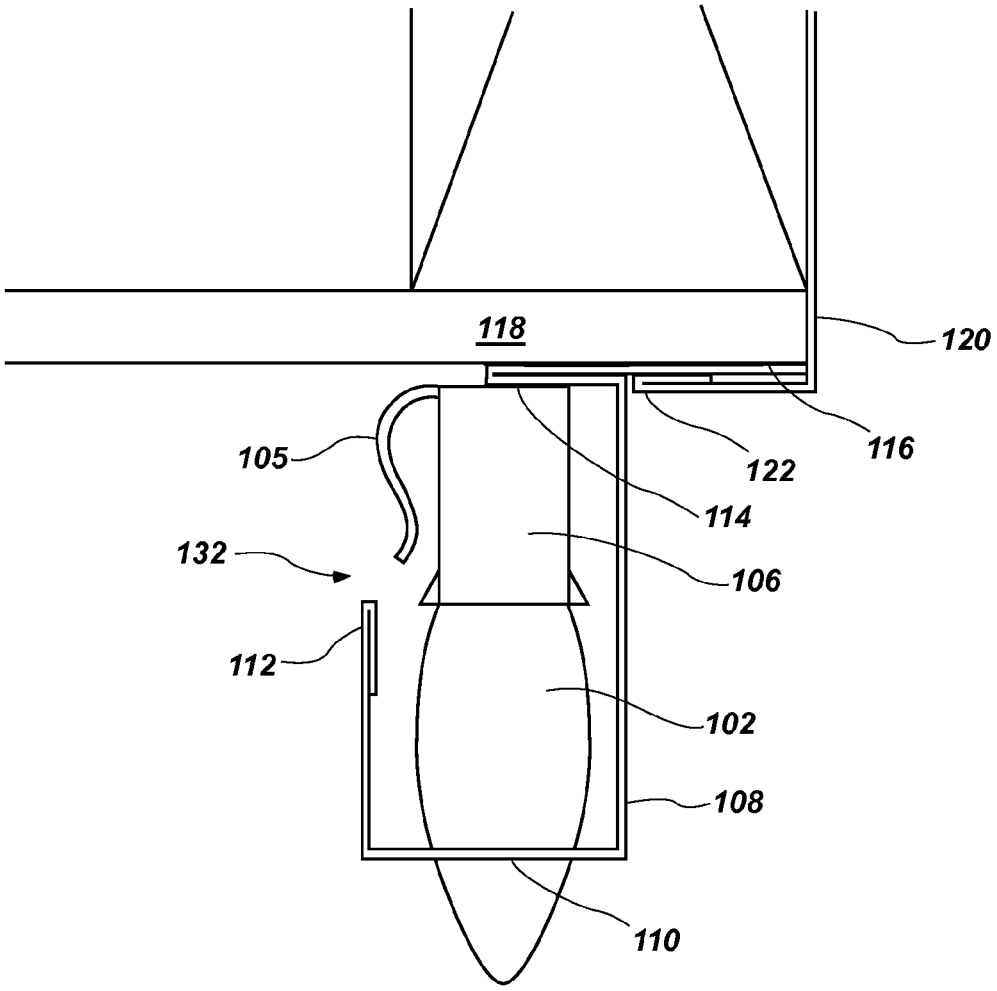
FIG. 1 shows a side-sectional view of a light mounting device according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
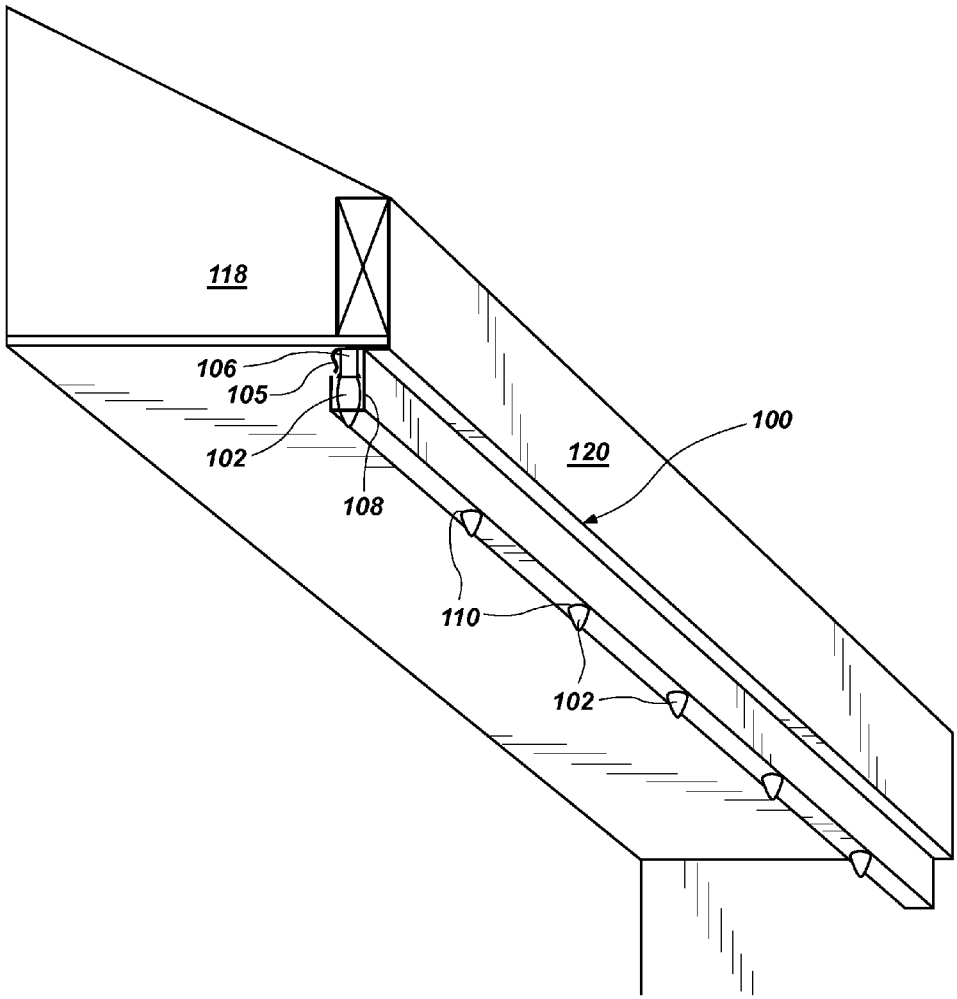
FIG. 2 shows a side perspective view of the light mounting device of FIG. 1 installed on a structure.
Figure 3:
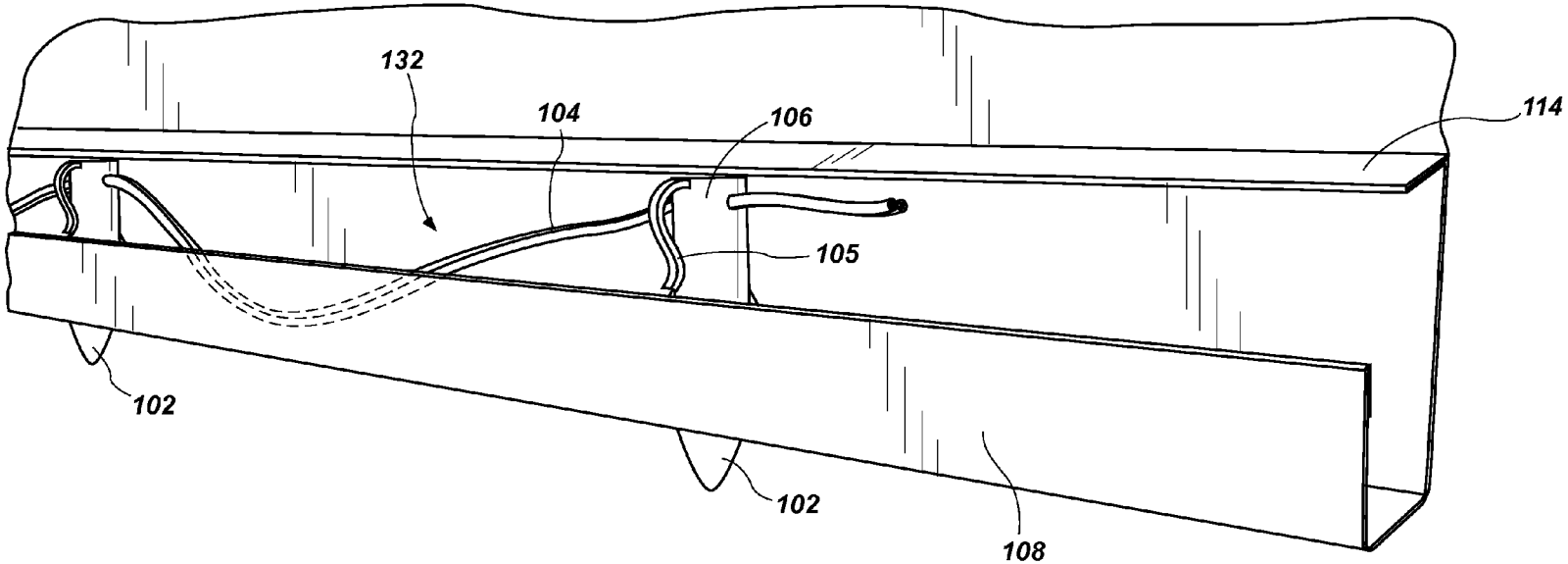
FIG. 3 shows a rear perspective view of a light mounting device according to one embodiment of the present invention.

Referring to FIGS. 1-3, a light mounting device 100 is shown according to one embodiment of the present invention. The string light system, for which this invention is particularly well suited, includes a bulb 102 seated in a socket 106. The bulb in this embodiment is a removable C7 or C9 sized light emitting diode (LED) bulb. However, it is noted that other sizes and bulb types may be incorporated into the present system including, but not limited to, incandescent bulbs and compact fluorescent (CFL). Additionally, the present invention in its various embodiments is well-suited for programmable lights—e.g. lights that can be adjusted throughout the year for different color displays; or chasing lights that are programmable for different speeds and directions. The string lights in the illustrated embodiments include a clip 105. The bulb 102 and socket 106 assembly is typically connected to other bulbs and sockets via electric cord 104.

The lights are placed in channel 108. The channel 108 in one embodiment is made of 0.027 coated aluminum. However, numerous other materials and combinations of materials could be utilized including but not limited to steel, copper, zinc, vinyl, plastic and combinations thereof. The channel 108 can include a rounded edge 112 which serves as a safety feature to prevent injury to a user as the lights are inserted into channel 108 through opening 132. In this embodiment, the rounded edge 112 is simply a bend in the outer edge of the channel 108. However, in some embodiments, it may be desirable to eliminate the rounded edge 112. As seen in FIGS. 7A and 8A, in some embodiments, the rounded edge can be bent in the opposite direction creating a J channel clip system that can couple with a back cover plate. In some embodiments, the bend could create a secondary channel into which a rope light or other similar light strand could be inserted.

As best seen in FIG. 2, the bottom surface of the channel 108 can include one or more openings 110 through which the light bulb 102 can protrude. The light mounting device 100 can also include a socket securing piece 114 (FIG. 1). This piece 114 serves to hold the light bulb 102 and socket 106 assembly in place to keep the lighting protruding through the open hole 110. As seen in FIG. 1, in this embodiment, the securing piece 114 is a folded edge of the channel 108, the bottom surface of which is able to press up against the socket 106; the top surface of which can rest underneath the soffit 118.

In this embodiment, the mounting device 100 is attached to a structure by inserting edge 116 underneath the fascia 120. In this embodiment, the fascia 120 can be bent 122 to better secure edge 116 in place.

In other embodiments, the mounting device 100 could be affixed directly to the soffit 118. For example, if the soffit is wood, the mounting device could be fastened to it with screws, nails or other mechanical attachment mechanisms that would be apparent to one skilled in the art. As will be discussed further below, slight variations in the shape and orientation of the mounting device 100 allow it to accommodate a variety of structure surfaces including, but not limited to, parapet caps for walls or flat roof systems.

FIG. 3 is a rear perspective view of a light mounting device 100 according to one embodiment of the present invention. This figure shows the light bulb 102, the socket 106, the electric cord 104 and the clamping piece 105 in the channel 108. FIG. 3 also depicts opening 132 through which the lights could be inserted. It is noted that the term channel is not intended to be limited to any particular cross-sectional configuration. For example, the channel 108 shown in FIGS. 1-3 has a substantially flat bottom surface at substantially right angles to the two side walls. However, in other embodiments, the channel could be u-shaped in cross-section. In yet other embodiments, the bottom surface (i.e. the surface through which the bulbs protrude—which depending on the orientation of the device 100 may in some situations not actually be on the "bottom" relative to the sides) could be at larger or smaller angles relative to the sides. In one embodiment, the channel could be substantially v-shaped.

Figure 4:
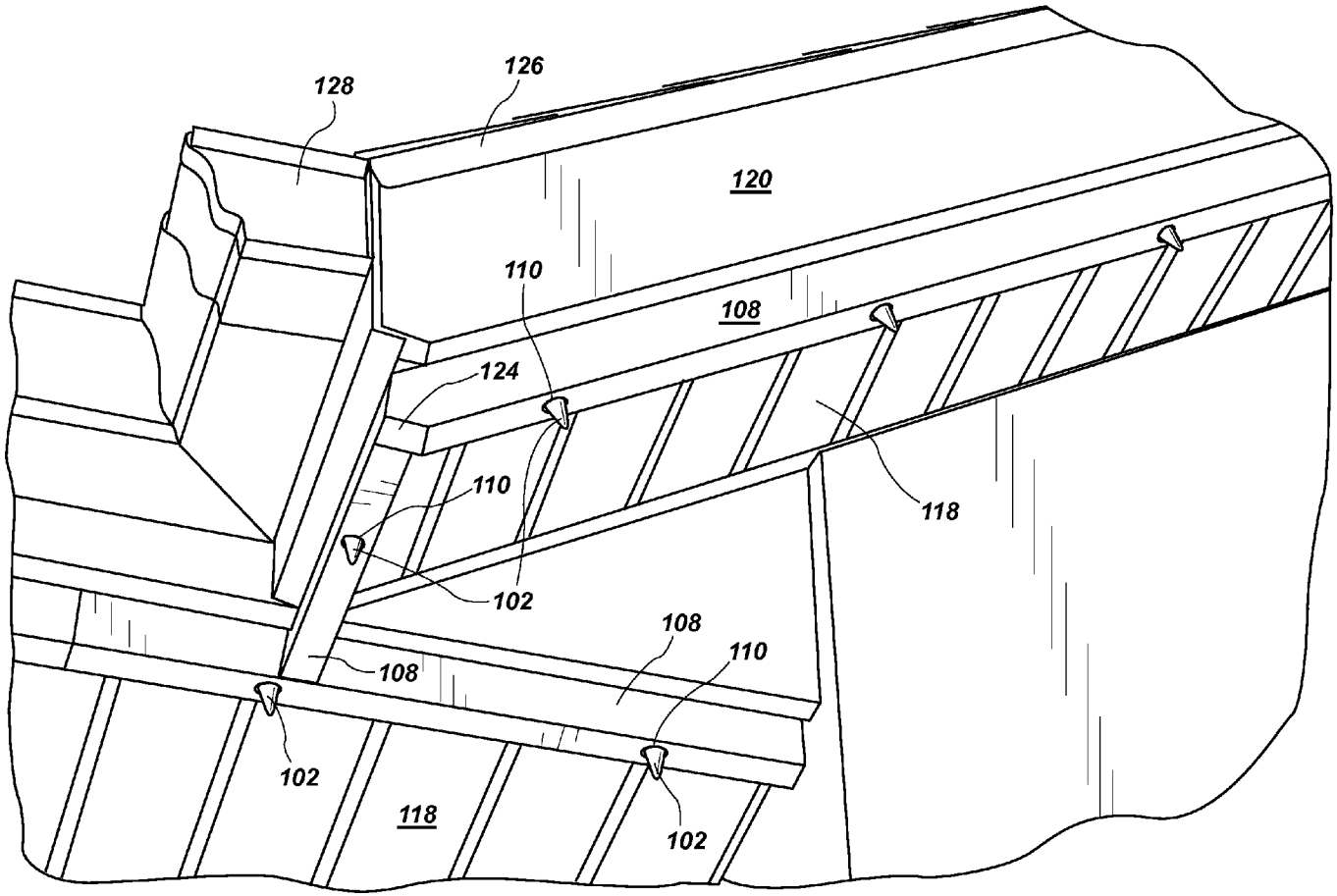
FIG. 4 shows an installed light mounting device according to one embodiment of the present invention.
Figure 5:
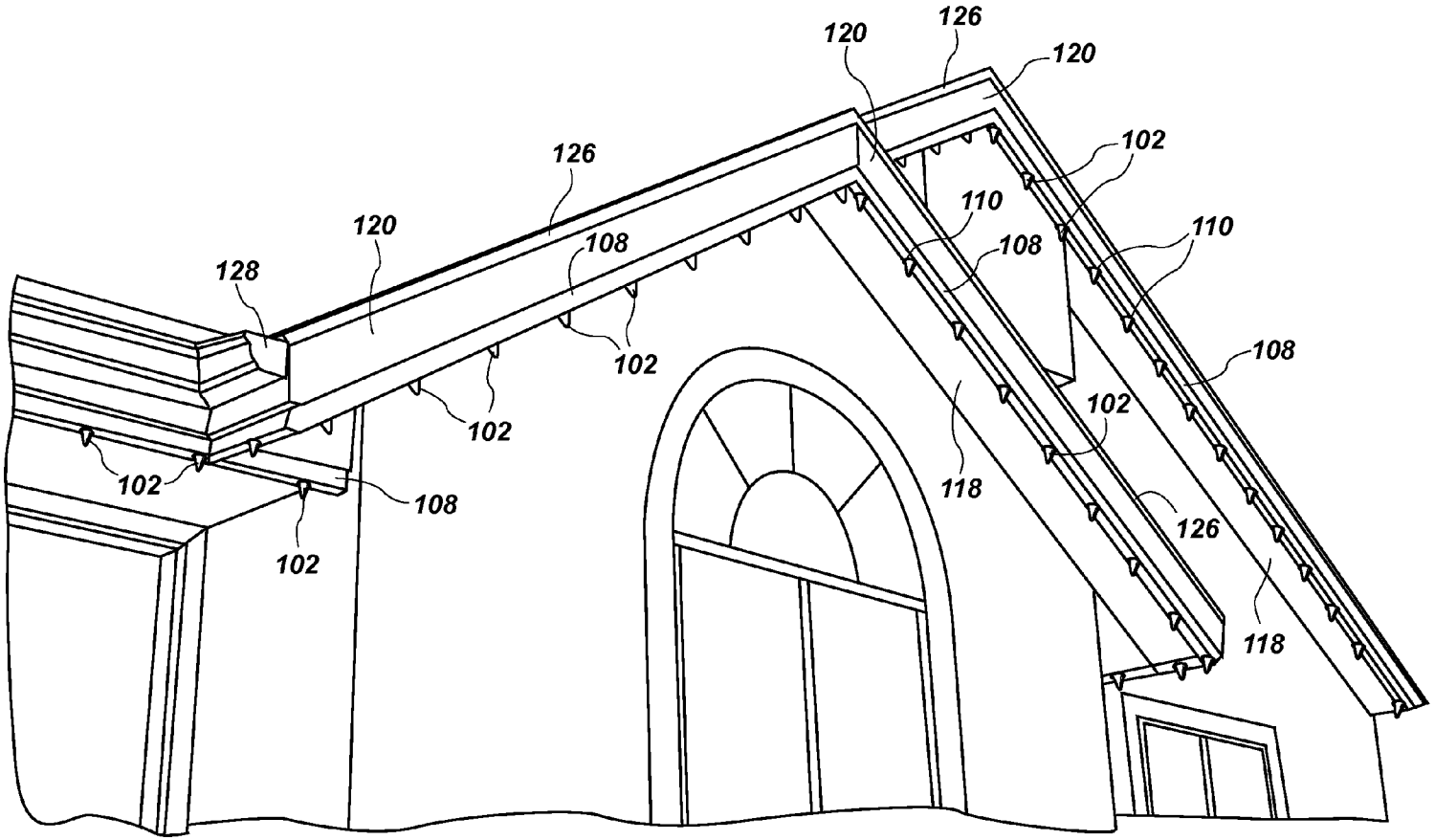
FIG. 5 shows an example of a house light display incorporating a light mounting device according to one embodiment of the present invention.

FIGS. 4 and 5 show installed light mounting devices according to one embodiment of the present invention. Notably, FIG. 4 illustrates how, through a series of joints or bends 124, the light mounting device can be adapted to a wide variety of structures and shapes. FIG. 4 also illustrates how the mounting device 100 can be inserted underneath the fascia 120 and does not interfere with guttering 128 or flashing 126. The fascia 120, which can be used to hold the light mounting device 100 in place, can be held in place with standard screws or other similar fasteners that would be apparent to one skilled in the art.

Figure 6B:
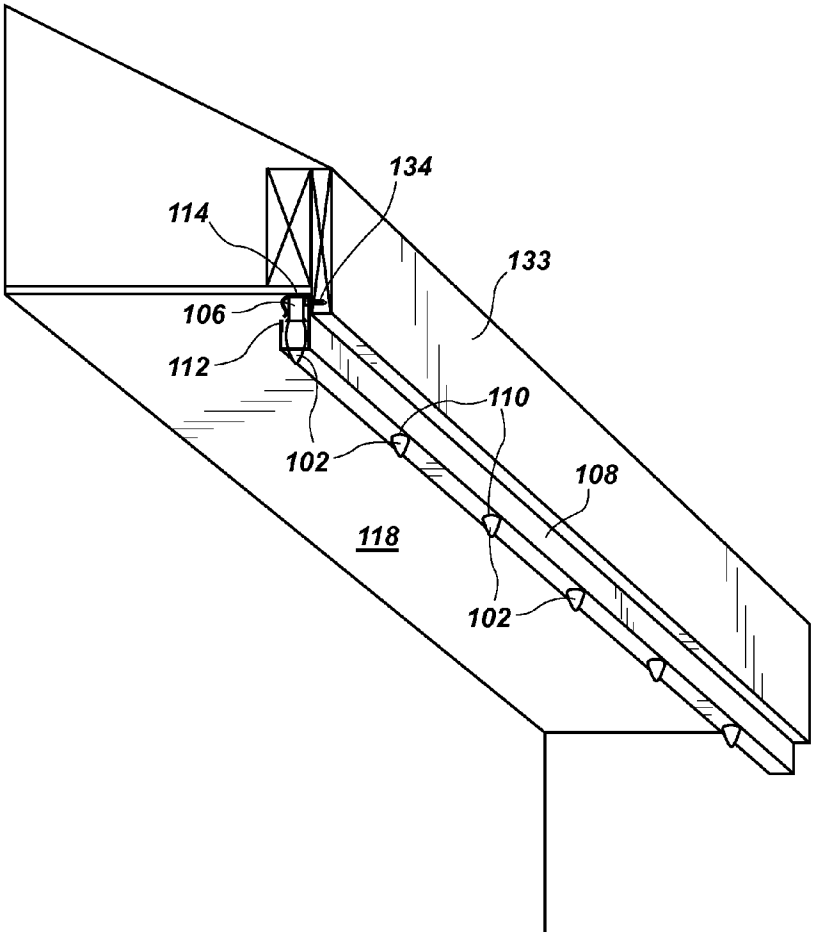
FIG. 6B shows a side perspective view of the light mounting device of FIG. 6A installed on a structure.
Figure 6A:
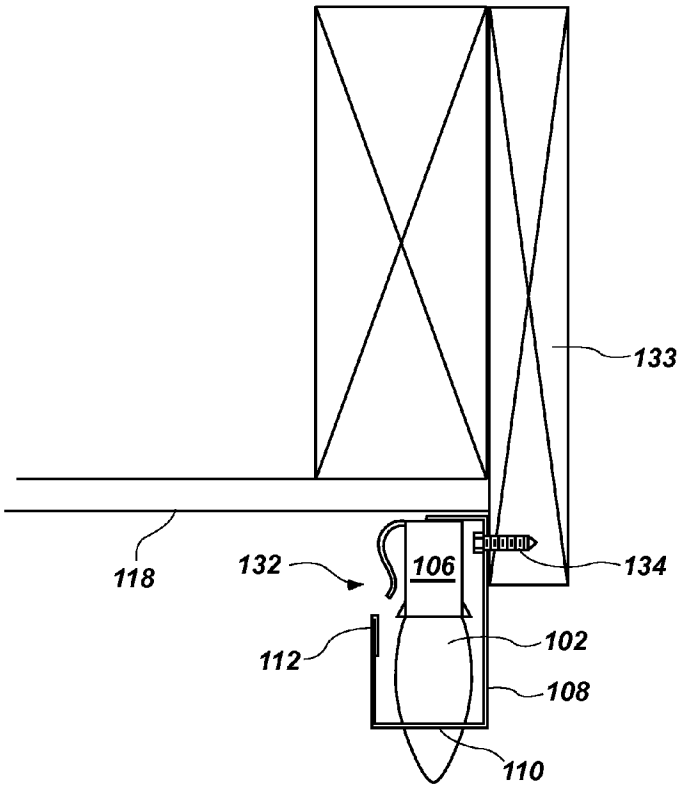
FIG. 6A shows a side-sectional view of a wood fascia application according to one embodiment of the present invention.

FIGS. 6A and 6B show an example of a light mounting device 100 according to one embodiment of the present invention. This particular application is well suited for structures having a wood fascia 133. The channel 108 in the illustrated embodiment is attached to the wood fascia 133 with a screw or lag bolt 134 or other similar attachment mechanism that would be apparent to one skilled in the art. The top edge of the channel 108 serves as securing piece 114.

Figure 7B:
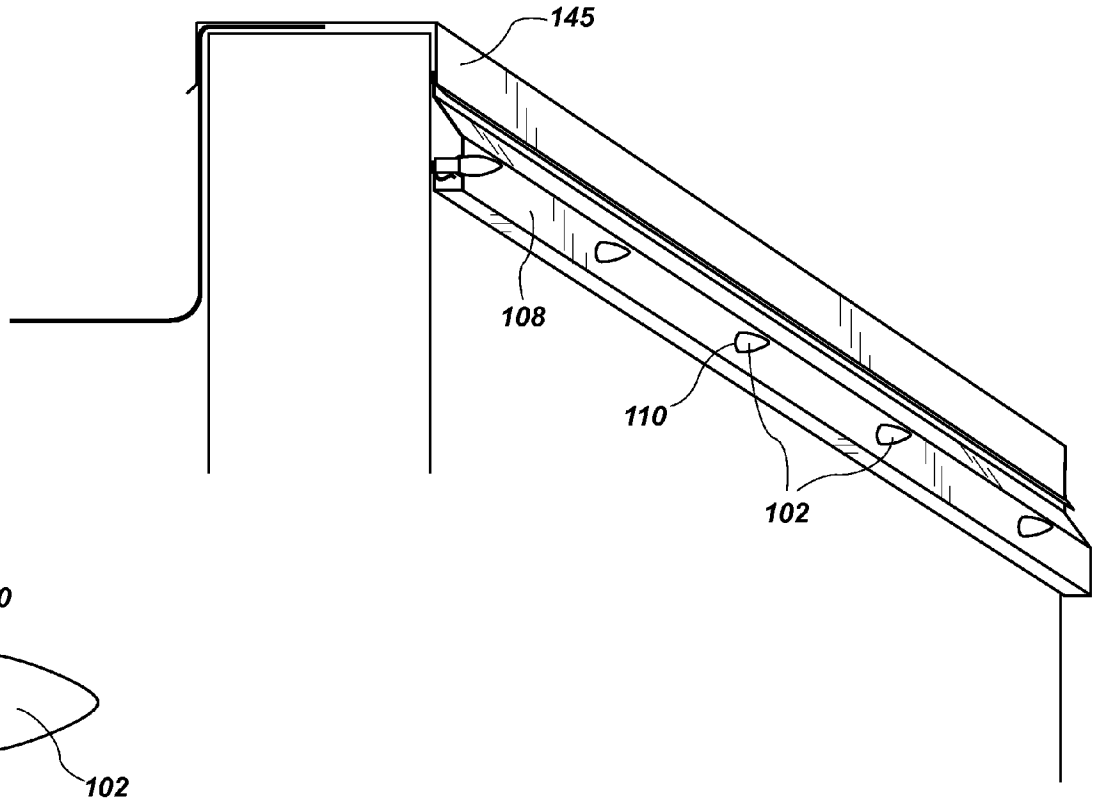
FIG. 7B shows a side perspective view of the light mounting device of FIG. 7A installed on a structure.
Figure 7A:
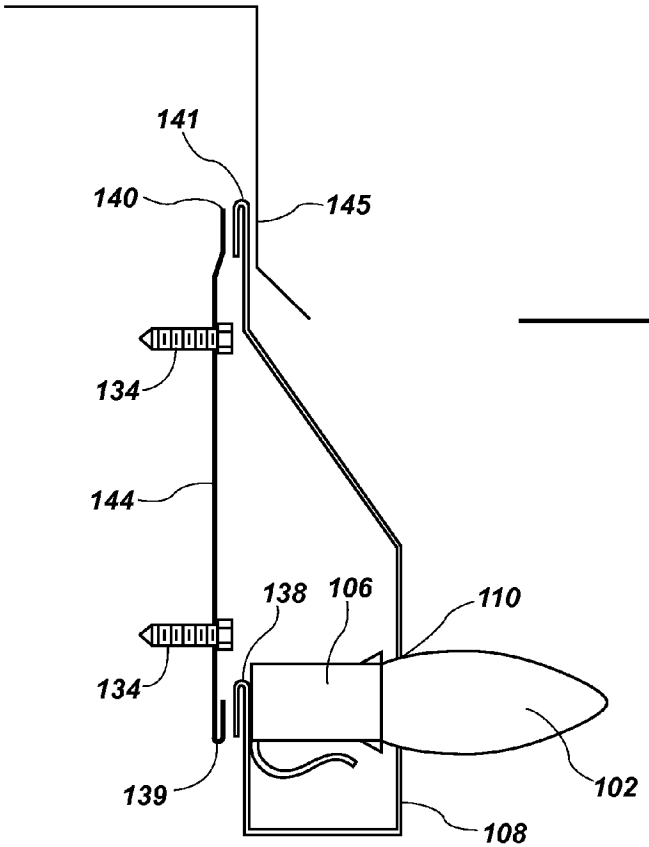
FIG. 7A shows a side-sectional view of an exposed face system for vertical wall applications according to one embodiment of the present invention.

FIGS. 7A and 7B show an example of a light mounting device 100 designed as an exposed face system for vertical wall applications. In this embodiment of the present invention the channel 108 is fastened to the structure by using a detachable clip base 144. The detachable clip base 144 can be made of numerous materials including but not limited to aluminum, steel, copper, zinc, vinyl, plastic or combinations thereof. In this embodiment, it is a substantially rectangular piece that runs coincidentally with the channel 108 along the structure. However, it is noted that the detachable clip base 144 could be numerous other shapes. It is also noted that in some instances, the base 144 could, instead of being a single continuous piece, be a series of smaller pieces that engage the channel 108 at predetermined points.

The top and bottom edges of the channel 108 are each bent into a J-shaped channel 138, 141. The top J channel 141 fits over the top edge 140 of the detachable clip base 144, as the bottom J channel 138 interlocks with another J channel 139 on the bottom of the detachable clip base 144. In this embodiment, the top edge 138 of the channel 108 and the top edge 140 of the detachable clip base 144 are inserted under a parapet cap or drip edge 145. The detachable clip base 144 could be secured to the structure by various mechanical means that would be apparent to one skilled in the art. In the illustrated embodiment, screws or lag bolts 134 are utilized. It is noted that in the embodiment illustrated in FIGS. 7A and 7B, the bottom edge 138 of the channel 108 serves as the socket securing mechanism.

Figure 8B:
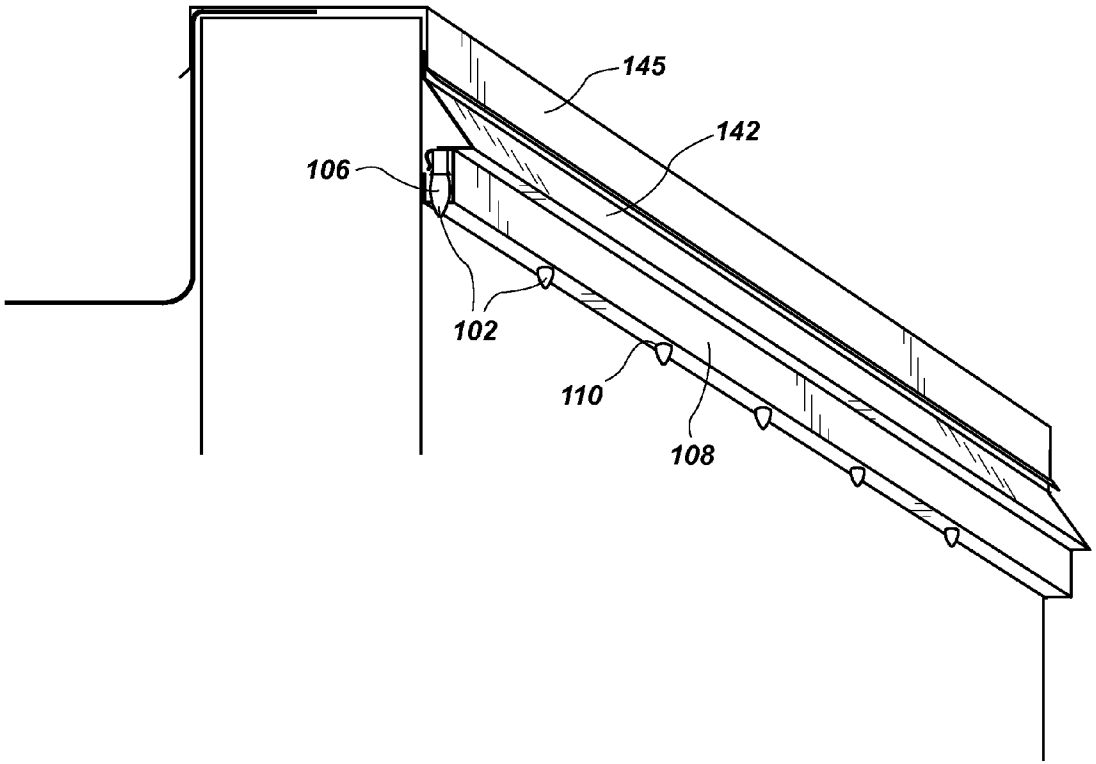
FIG. 8B shows a side perspective view of the light mounting device of FIG. 8A installed on a structure.
Figure 8A:
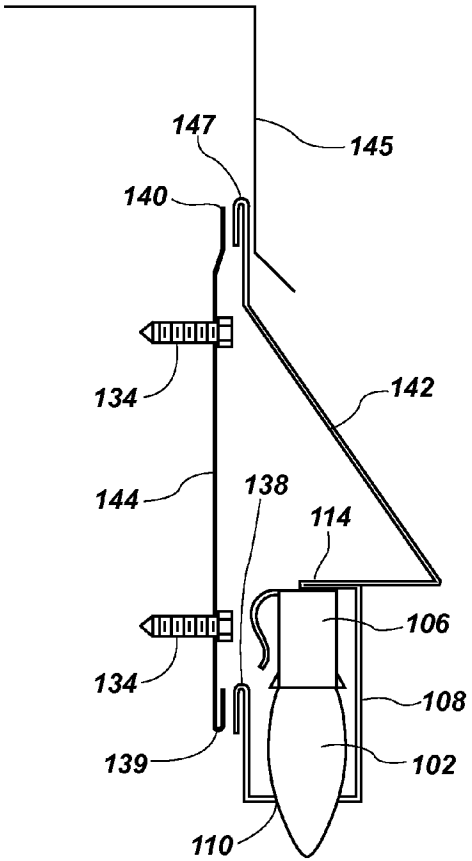
FIG. 8A shows a side-sectional view of a hidden system for vertical wall applications according to one embodiment of the present invention.

FIGS. 8A and 8B show a hidden system version of a light mounting device 100 for vertical wall applications according to one embodiment of the present invention. As with previously discussed embodiments, in this embodiment the channel 108 is fastened to the structure by using a detachable clip base 144 capable of interlocking with top and bottom edges 138, 141 of the channel 108—namely, the top J channel 141 fits over the top edge of the detachable clip 140, as the bottom J channel 138 interlocks with another J channel 139 on the bottom of the detachable clip base 144. Again, in this embodiment, the top edge 138 of the channel 108 and the top edge 140 of the detachable clip base 144 are inserted under a parapet cap or drip edge 145 and the detachable clip base 144 can be secured to the structure by various mechanical means that would be apparent to one skilled in the art including, but not limited to, screws or lag bolts 134. The bulb and socket assembly are held in place by securing mechanism 114. It is noted that this embodiment of the invention features a sloped drip cap 142 that helps protect the bulb 102 and socket 106 assembly from moisture in instances where there is little or no roof overhang. The sloped drip cap 142 and channel 108 can be a single piece as is shown in the illustrated embodiment. In other embodiments, the sloped drip cap 142 could be separately attached to the channel 108. The top edge of the detachable clip 140 and the upper J channel 147 of the drip cap 142 fit together underneath the parapet cap or drip edge of the wall 145.

Figure 9B:
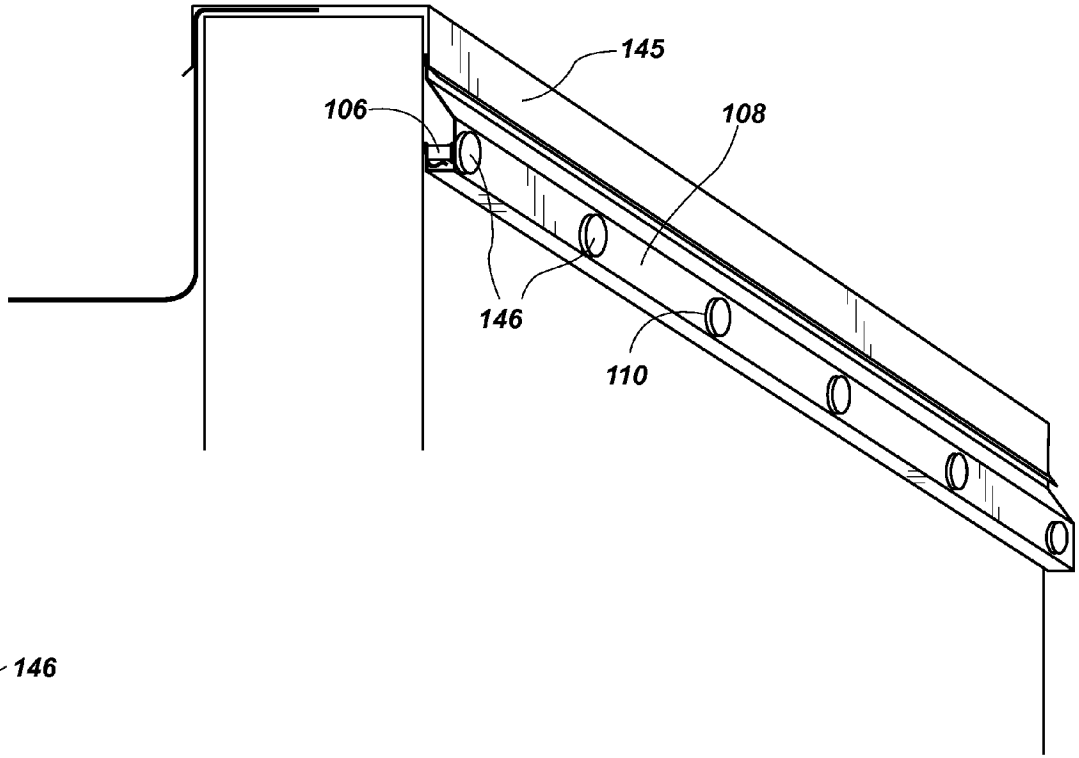
FIG. 9B shows a side perspective view of the light mounting device of FIG. 9A installed on a structure.
Figure 9A:
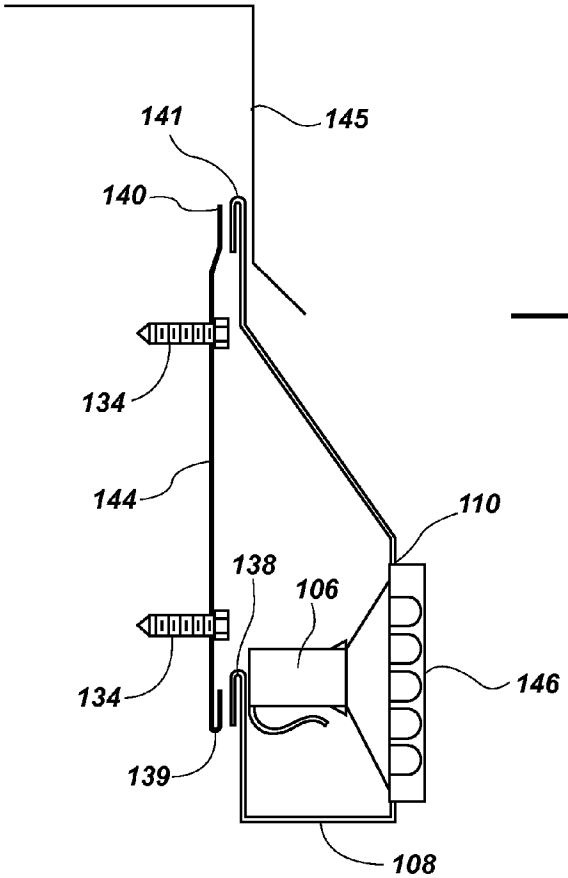
FIG. 9A shows a side-sectional view of a high density LED exposed face system according to one embodiment of the present invention.

Another embodiment of the present invention uses high density LED bulbs 146 as illustrated in FIGS. 9A and 9B. This application uses the same method of attaching the channel 108 to a detachable clip base 144 as illustrated in FIGS. 7A and 7B with the J channel 138 acting as the socket securing mechanism too.

Figure 10B:
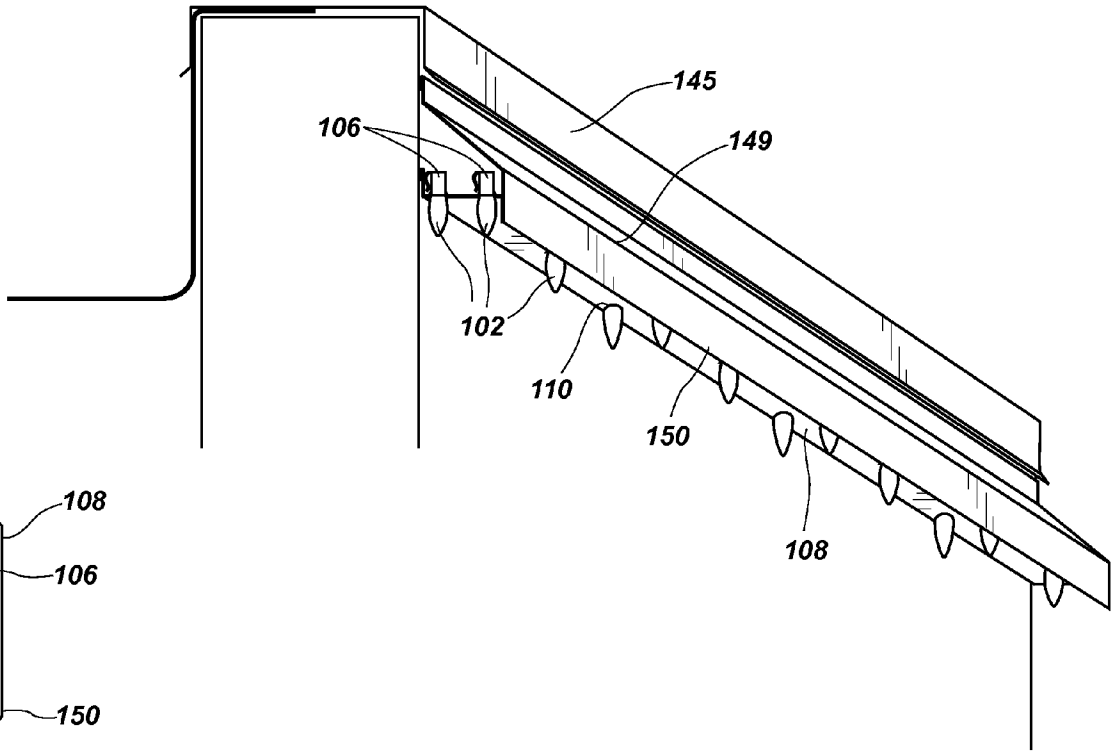
FIG. 10B shows a side perspective view of the light mounting device of FIG. 10A installed on a structure.
Figure 10A:
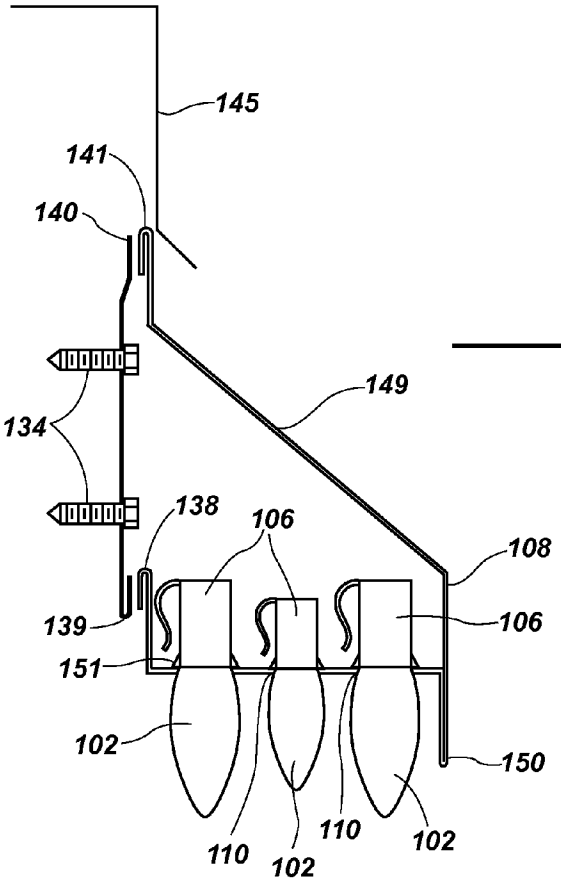
FIG. 10A shows a side-sectional view of a triple light system for vertical wall applications according to one embodiment of the present invention.

FIGS. 10A and 10B show a multiple light system for vertical wall applications according to one embodiment of the present invention. This system is attached to a wall with a detachable clip base 144 as illustrated in FIGS. 7A-9B. In this embodiment of the present invention there are three (3) openings 110 through which light bulbs 102 can protrude. Other embodiments could include more or fewer openings 110. The openings 110 could also be of varying sizes to accommodate different sizes and styles of lights. It is also noted that in all of the foregoing embodiments, multiple light strands could be accommodated by expanding the channel 108 width as needed and providing additional openings 110—regardless of the specific attachment mechanism utilized.

The embodiment illustrated in FIGS. 10A and 10B includes a sloped drip cap 149 incorporated into the channel 108 and culminating in a protective edge 150. Edge 150 serves to direct water downward away from the lights. It also acts as a frontal shield protecting the lights from damage caused by a variety of conditions including sunlight, high winds and windblown objects.

It is also noted that, in a number of the foregoing illustrated embodiments, the sockets 106 include expanded edges 151 (FIG. 10A). These expanded socket edges 151 are common in string lights. Depending on how exposed one wishes the lights to be, the expanded edges 151 can be utilized to hold the bulbs 102 in place. For example, in some instances, the opening 110 will be only large enough to permit a portion of the bulb through. The width of the bulb 102 itself prevents it from going all the way through the opening 110. As has been discussed previously, the position of the bulb 102 and socket 106 can be held by a securing mechanism (e.g. 114). In other instances, it may be desirable to have the bulb almost entirely exposed. In such instances, the expanded edges 151 of the socket 106 could be used to prevent the entire bulb and socket assembly from slipping through the opening. To illustrate, when installing, one would place a bulb-less strand of lights in channel 108 and then hold the empty socket over opening 110 while a bulb 102 was inserted into socket 106 from underneath the channel 108. This could be done for some or all of the lights in that strand. By so installing, the width of the bulb 102 would prevent it from moving significantly up through the opening 110 and the expanded edges 151 would prevent the socket 106 from moving significantly down through the opening 110. Other mechanisms could be utilized to secure the bulb 102 and socket 106 assemblies in place. For example, when the sockets 106 do not include expanded edges 151, collars or other diameter expanding mechanisms could be utilized to enlarge the socket 106 such that it does not simply fall through opening 106.

Figure 11A:
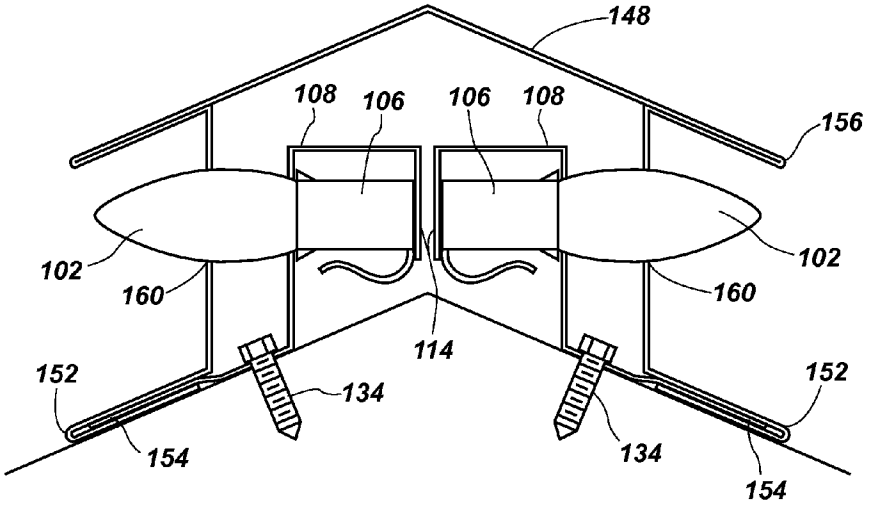
FIG. 11A shows a side-sectional view of an exposed face system for ridge line roofs according to one embodiment of the present invention.

FIGS. 11A and 1 lB show an exposed face system for ridge line roofs. In this system, two (2) channels 108 are attached to the roof ridgeline with a bulb 102 pointing to each downward slope of the roof. The channels 108 are secured to the roof with screws or lag bolts 134. A ridge cap cover 148 can be attached to the edges 154 of the two channels 108 by means of interlocking J channels 152. The ridge cap cover 148 in this embodiment includes openings 160 on both sides to accommodate the protruding bulbs 102. The ridge cap cover 148 can be made of numerous materials including, but not limited to aluminum, steel, copper, zinc, vinyl, plastic or combinations thereof. The ridge cap cover 148 can include an edge 156 that diverts moisture away from the bulb 102 and also protects against other environmental damage.

Figure 12B:
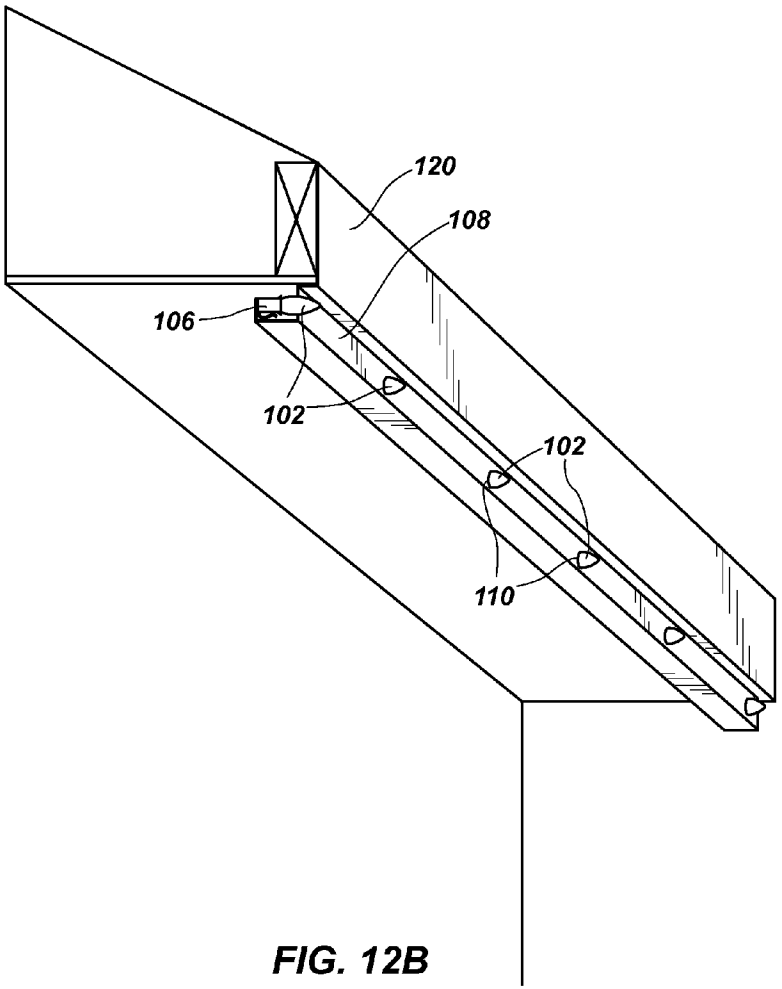
FIG. 12B shows a side perspective view of the light mounting device of FIG. 12A installed on a structure.
Figure 12A:
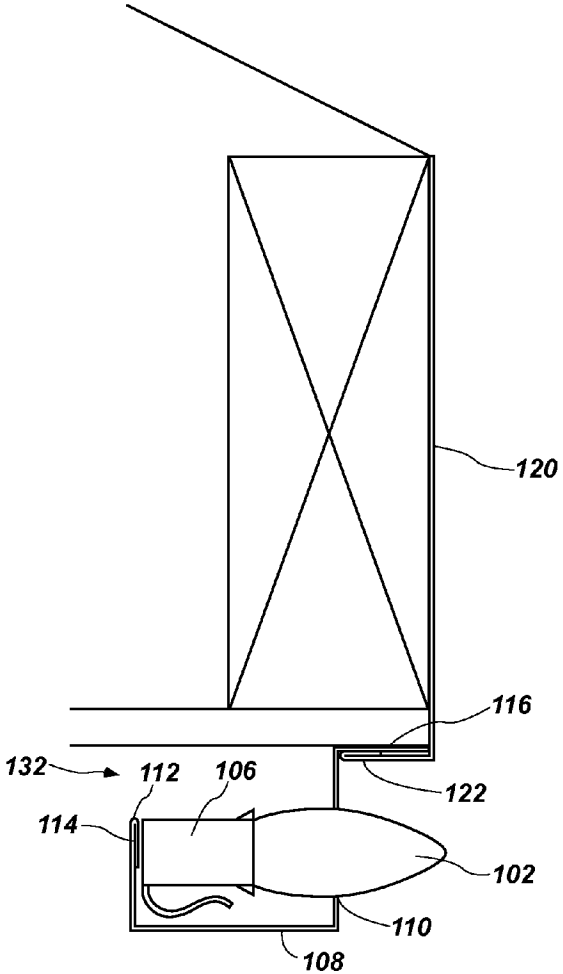
FIG. 12A shows a side-sectional view of an exposed face system for soffited fascia applications according to one embodiment of the present invention.

FIGS. 12A and 12B show an exposed face system for soffited fascia applications according to one embodiment of the present invention. This embodiment functions similarly to the embodiment discussed in connection with FIG. 1—they key difference being the orientation of the light bulb 102 and socket 106 assemblies.

Figure 13B:
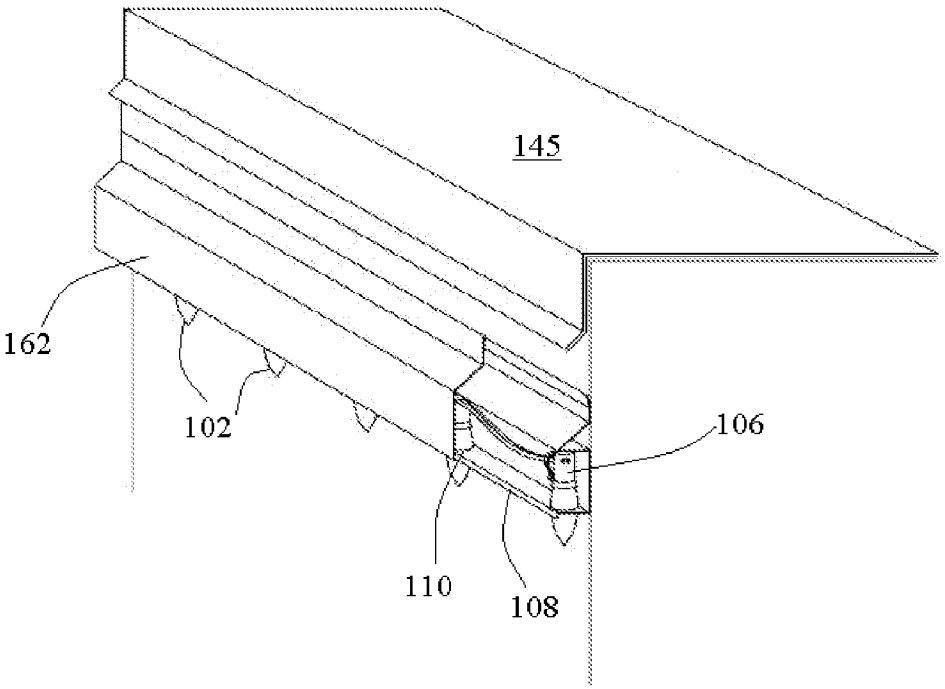
FIG. 13B shows a side perspective view of the light mounting device of FIG. 13A installed on a structure.
Figure 13A:
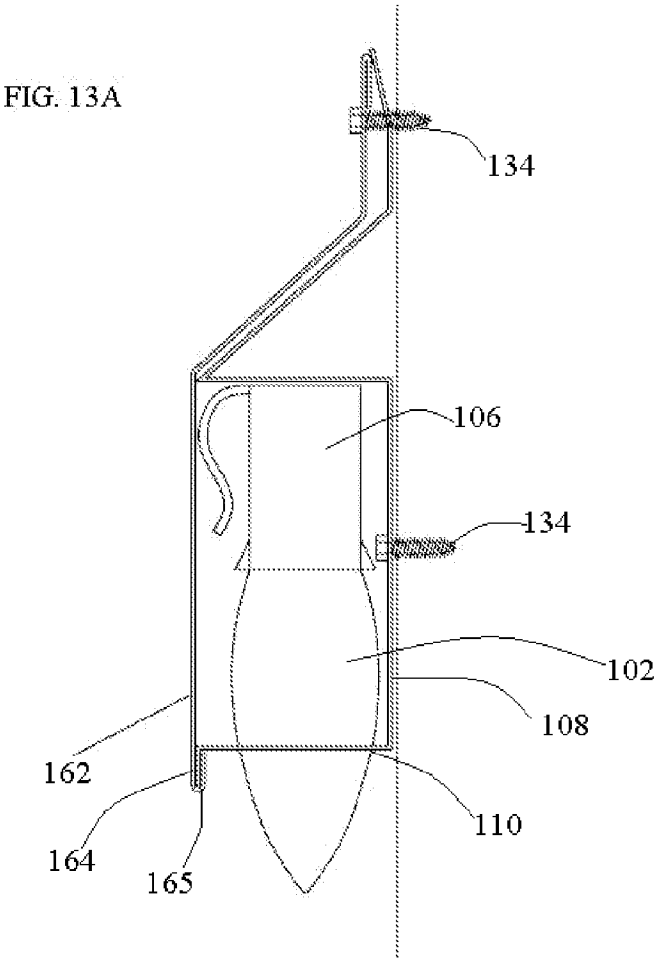
FIG. 13A shows a side-sectional view of a hidden system for vertical wall applications according to one embodiment of the present invention.

FIGS. 13A and 13B show a hidden system for vertical wall applications. This particular embodiment has the channel 108 attached directly to the structure with a fastening mechanism 134 such as a lag bolt or screw. It also includes a removable cover 162 secured to the channel 108 at one end with a common fastening mechanism 134 although it is noted that in certain embodiments, J clips and other similar connection means may be desirable—e.g. a J clip on a top edge of the removable cover 162 capable of engaging a top edge of the channel 108. In yet other embodiments, combinations of these connection means may be desirable. The other end of the cover 162 includes a J clip 164 capable of engaging an edge 165 of the channel 108. This configuration allows for easy removal of the cover 162 when needed. As seen in FIG. 13B, this example shows the device 100 mounted below a parapet cap or drip edge 145.

Figure 11B:
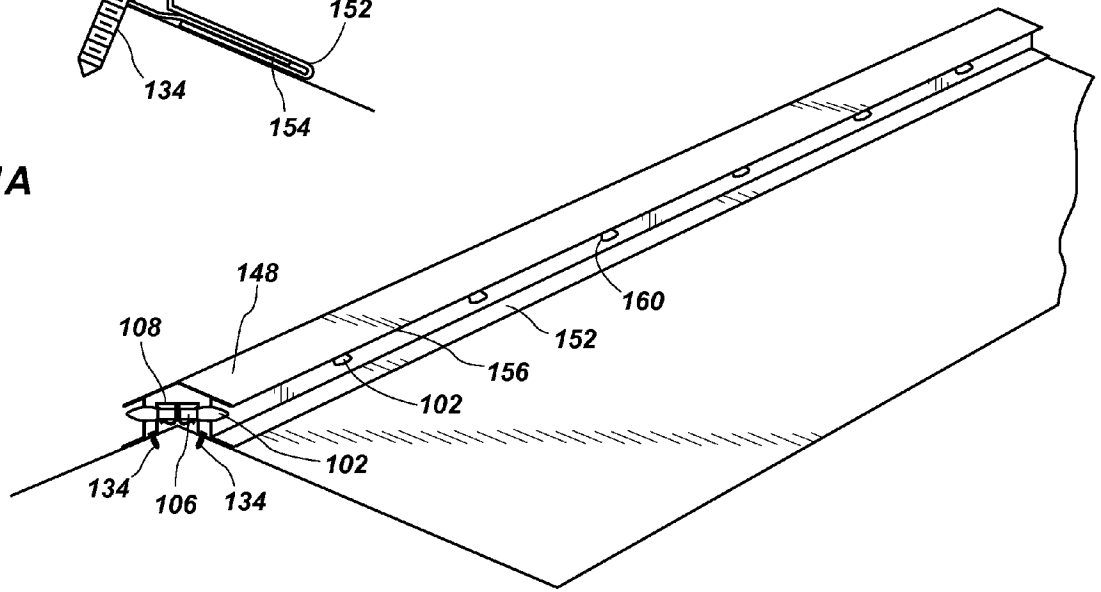
FIG. 11B shows a side perspective view of the light mounting device of FIG. 11A installed on a structure.

It is understood that the above-described arrangements are only illustrative of the application of the basic principles of the present invention. Numerous modifications and alternative arrangements may be devised by those skilled in the art without departing from the spirit and scope of the present invention. Each application may also differ depending on the current architecture of the building and combinations of the foregoing features may be made depending on need and circumstances. Moreover, in certain embodiments discussed above, J clips on the channel are shown engaging edges of a detachable base 144. However, in certain instances, it may be desirable to have the J clips on the base 144 that engage with a substantially straight edge on the channel. Similarly, with regard to FIGS. 11A and 11B, the J clips 152 are shown on the cover 148 and the corresponding edges 154 are on the channels 108. However, it is noted that the J clips could be on the channel 108 and the corresponding edges be on the cover 148; or in some instances, it may be desirable to include J clips on both the channels 108 and the cover.

What is claimed is:

1. A device for mounting lights to a structure comprising: a) a first channel defining an enclosure and having one or more openings in a surface of the first channel capable of receiving a first light bulb, wherein the first channel further includes a securing mechanism to secure the first light bulb substantially in the one or more openings; and b) a first attachment mechanism whereby the first channel is attached to the structure.

2. The device of claim 1, wherein the first attachment mechanism is a mounting edge coupled to the channel and capable of being inserted under a fascia of the structure.

3. The device of claim 1, wherein the first attachment mechanism is a first J clip on a first edge of the channel capable of engaging a first edge of a detachable clip base.

4. The device of claim 3, wherein the first attachment mechanism further includes a second J clip on a second edge of the channel capable of engaging a second edge of the detachable clip base.

5. The device of claim 4, wherein the second edge of the detachable clip base is also a J clip.

6. The device of claim 3, wherein the detachable clip base is a single, substantially rectangular piece running substantially coincidental with the channel on the structure.

7. The device of claim 3, wherein the detachable clip base is more than one pieces running substantially coincidental with the channel on the structure.

8. The device of claim 3, wherein the first J clip on a first edge of the channel and the first edge of the detachable clip base are engaged under a drip edge of a parapet cap.

9. The device of claim 1, wherein the securing mechanism also can function as a J clip to secure the channel to the structure.

10. The device of claim 1, wherein the channel further includes a sloped drip cap.

11. The device of claim 1, further comprising a second channel defining a second enclosure and having one or more openings in a surface of the second channel capable of receiving a second light bulb; and having a second attachment mechanism whereby the second channel is attached to the structure; and wherein the first and second channels are positioned such that the first and second light bulbs point in substantially opposite directions.

12. The device of claim 11, wherein the first and second attachment mechanisms are one or more items selected from the group consisting of lag bolts, screws and nails.

13. The device of claim 12, further comprising a ridge cap cover coupled to the first and second channel.

14. The device of claim 13 wherein the ridge cap cover includes one or more cover openings through which at least a portion of the first and second light bulbs is visible.

15. The device of claim 13 wherein a first and a second edge of the ridge cap cover are J clips.

16. The device of claim 15, wherein the first and second channels include a first and second edge that are capable of engaging the J clips on the ridge cap cover and thereby secure the roof cap cover to the structure.

17. The device of claim 1, wherein the channel is made of one or more materials selected from the group consisting of aluminum, steel, copper, zinc, vinyl and plastic.

18. The device of claim 1, wherein the first channel is attached to the structure at a soffit.

19. The device of claim 1, wherein the light bulb is an LED bulb.

* * * * *